US008739677B1

(12) United States Patent
Robbins et al.

(10) Patent No.: US 8,739,677 B1
(45) Date of Patent: Jun. 3, 2014

(54) BORESIGHT VERIFICATION DEVICE

(75) Inventors: James Travis Robbins, Dahlgren, VA (US); Luis J. Rodriguez, King George, VA (US); Danny L. Wilson, Spotsylvania, VA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 304 days.

(21) Appl. No.: 13/374,177

(22) Filed: Dec. 5, 2011

(51) Int. Cl.
*F41G 1/00* (2006.01)

(52) U.S. Cl.
USPC ..... 89/41.19; 42/121; 42/134

(58) Field of Classification Search
USPC ..... 89/41.19; 42/120–121, 134; 434/21–23, 434/19
See application file for complete search history.

(56) References Cited

U.S. PATENT DOCUMENTS

| | | | | | |
|---|---|---|---|---|---|
| 1,277,932 | A * | 9/1918 | Hollifield | 434/19 |
| 3,112,567 | A * | 12/1963 | Flanagan | 42/121 |
| 3,711,204 | A * | 1/1973 | Steck, III | 356/153 |
| 3,744,133 | A * | 7/1973 | Fukushima et al. | 42/121 |
| 3,782,740 | A * | 1/1974 | Peyrot | 279/2.23 |
| 3,908,282 | A * | 9/1975 | Steffan | 42/121 |
| 4,090,305 | A * | 5/1978 | Cassidy | 42/121 |
| 4,095,347 | A * | 6/1978 | Steffan | 42/121 |
| 4,773,164 | A * | 9/1988 | Taylor et al. | 33/520 |
| 4,789,861 | A | 12/1988 | Baggett et al. | 342/152 |
| 4,919,528 | A | 4/1990 | Pitalo et al. | 359/406 |
| 5,005,308 | A * | 4/1991 | Parks | 42/122 |
| 5,396,708 | A * | 3/1995 | Whitley | 42/121 |
| 5,442,860 | A * | 8/1995 | Palmer | 42/120 |
| 5,499,455 | A * | 3/1996 | Palmer | 42/120 |
| 5,878,504 | A * | 3/1999 | Harms | 42/120 |
| 6,289,782 | B1 * | 9/2001 | Watson, Jr. | 89/37.01 |
| 6,295,753 | B1 * | 10/2001 | Thummel | 42/116 |
| 6,397,509 | B1 * | 6/2002 | Langner | 42/116 |
| 6,813,855 | B2 * | 11/2004 | Pinkley | 42/120 |
| 7,644,531 | B2 * | 1/2010 | Musser | 42/121 |
| 7,665,218 | B1 * | 2/2010 | Pinto | 33/333 |
| 7,685,760 | B1 * | 3/2010 | Neumaster | 42/129 |
| 7,900,391 | B1 * | 3/2011 | Mihelish | 42/116 |
| 8,006,427 | B2 | 8/2011 | Blevins et al. | 42/115 |
| 8,286,383 | B2 * | 10/2012 | Matthews | 42/122 |
| 2003/0177685 | A1 * | 9/2003 | Pinkley | 42/135 |
| 2007/0113460 | A1 * | 5/2007 | Potterfield et al. | 42/120 |
| 2007/0240357 | A1 * | 10/2007 | Musser | 42/134 |

* cited by examiner

*Primary Examiner* — Michelle Clement
(74) *Attorney, Agent, or Firm* — Gerhard W. Thielman, Esq.

(57) ABSTRACT

A boresight verification device (BVD) comprised of a circular housing with a rear portion of smaller diameter and a front portion of larger diameter. The front portion securely holds a level. The circular housing also contains a plurality of spring plungers which grip the inside of a muzzle when BVD is inserted into a muzzle for use. A tooling ball provides a stable reference point.

18 Claims, 4 Drawing Sheets

BORESIGHT VERIFICATION DEVICE

STATEMENT OF GOVERNMENT INTEREST

The invention described herein was made in the performance of official duties by one or more employees of the Department of the Navy, and the invention herein may be manufactured, practiced, used, and/or licensed by or for the Government of the United States of America without the payment of any royalties thereon or therefore.

FIELD OF INVENTION

The present invention relates to the field of sight mount adjustment components, and specifically to a device which verifies the continued alignment of a sight unit and the center line of a bore.

TERMINOLOGY

Figure 1:
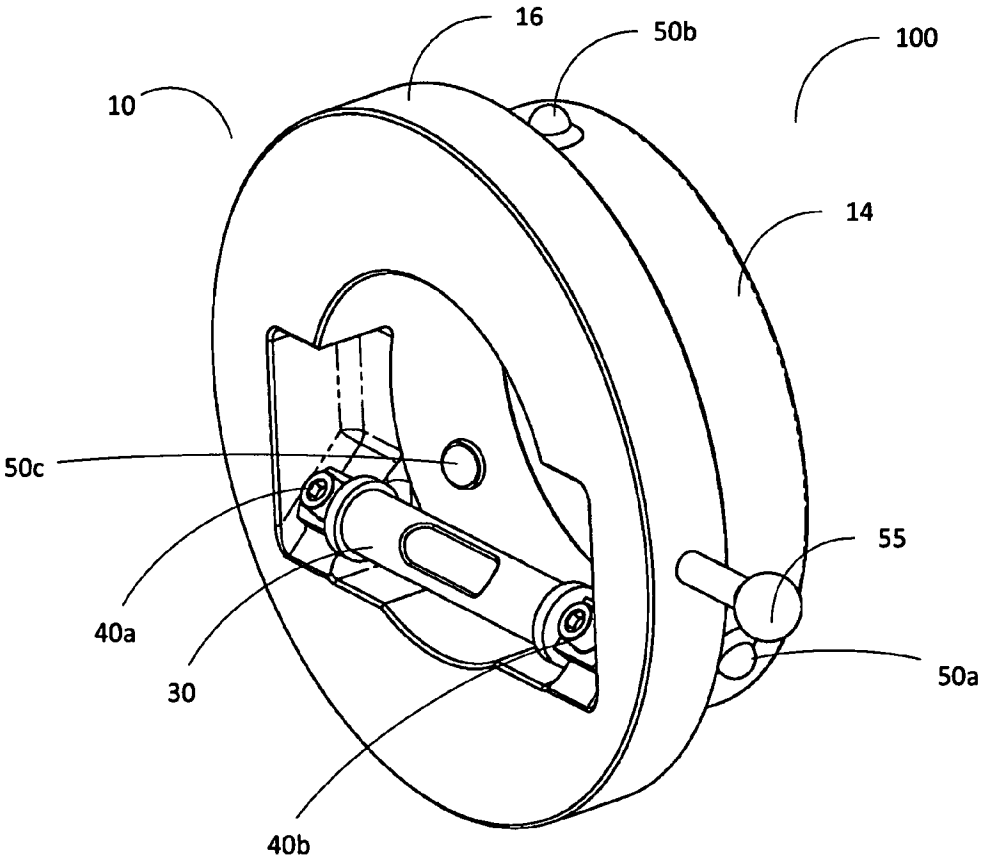
FIG. 1 illustrates an exemplary embodiment of a boresight verification device (BVD).

As used herein, the term "securing component" refers to any structure or device used to securely attach two components. Securing components may include, but are not limited to, screws, shoulder screws, set screws, screw/lock washer assemblies, adhesives, welding, brazing, nails, bolts, spring plungers, expanding jaws or collars, spring-loaded feet, tapered shafts and combinations of these and other structures or devices known in the art. Securing components may create permanent or temporary bonds.

BACKGROUND OF THE INVENTION

The current apparatus to accomplish bore sight verification is a large assembly of two parts, the M154 Alignment Device and the Bore Sight Adapter, both known in the art. The Bore Sight Adapter is inserted into the mortar bore and rotated to level. The M154 is then assembled onto the dovetail of the Bore Sight Adapter. The user views the crosshairs inside the M154 collimator through the sight mounted on the weapon, and uses the micrometer knobs to align the crosshairs of the M154 and the weapon's sight. The user then reads the angle measured from the micrometer knob and compares the new, measured value to the standard value. If the measured value is the same as the standard value within tolerance, the mortar is considered to have a verified bore sight.

The current method and equipment has a number of limitations and disadvantages.

The Bore Sight Adapter uses a rubber o-ring to locate and hold the assembly level in the bore. This o-ring must maintain a coat of grease. If ungreased, the o-ring will tear when the Bore Sight Adapter is leveled. However, excessive grease is also an issue; with excessive grease, the o-ring will no longer hold, allowing the weight of the M154 and the Bore Sight Adapter to pull the unit out of level. If the o-ring falls down the bore of the mortar, no tool exists to retrieve it. Therefore, the mortar must be taken back to the depot for special maintenance to disassemble the weapon in order to extract the o-ring.

The Bore Sight Adapter uses a dovetail-style mount to secure the M154. However, there is no physical locator to force the M154 to be in the same place from use to use, creating the problem of repeatability in measurements. The level vial used to level the assembly is located at the top of the Bore Sight Adapter. In this location, it is difficult to read, and it is unprotected from impact and the elements.

To use the weapon, the mortar must be elevated to a point near the extreme limit of travel. Not only does this take valuable emplacement time and effort, it also presents a set of optically-related challenges. The M154 must be in the same optical plane as the sight telescope for proper operation. When on solid ground before firing, the base plate of the mortar is sitting on the ground and this is not an issue. If the users must verify bore sight after firing, the base plate has sunk into the ground, and it may no longer be possible to elevate the mortar to the proper elevation for verifying bore sight. In this case, the weapon must be relocated, laid, and bore sight must be verified again before allowed to fire, which would take several minutes.

The manufacturing tolerance stack-up from the o-ring to the end of the M154 is excessive. Tolerance stack-up is a phenomenon which occurs when the individual parts of a component are all manufactured within required specifications, but the resulting larger component is out of tolerance as a result of the variances of its components. For example, if a 12-inch (±0.5) bar is needed out of three 4-inch (±0.2) components, it is possible to have a 12.6-inch bar, which is out of tolerance, comprised of three 4.2-inch components, each of which is in tolerance.

The tolerance stack-up from the o-ring to the end of the M154 increases the angle tolerance, resulting in a large tolerance which is unacceptable in the artillery field. The size of the M154 and Bore Sight Adapter are also a potential hindrance due to the large protective case they are stored in. When loaded, the case is heavy and takes up a large amount of the valuable cargo area inside a vehicle.

SUMMARY OF THE INVENTION

The present invention is a boresight verification device (BVD) comprised of a circular housing with a rear portion of smaller diameter and a front portion of larger diameter. The front portion securely holds a level. The circular housing also contains a plurality of spring plungers that grip the inside of a muzzle and center the BVD in the muzzle when the BVD is inserted into a muzzle for use. A tooling ball provides a stable reference point.

DETAILED DESCRIPTION

For the purpose of promoting an understanding of the present invention, references are made in the text to exemplary embodiments of a boresight verification device, only some of which are described herein. It should be understood that no limitations on the scope of the invention are intended by describing these exemplary embodiments. One of ordinary skill in the art will readily appreciate that alternate but functionally equivalent materials, components, and devices may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

It should be understood that the drawings are not necessarily to scale; instead, emphasis has been placed upon illustrating the principles of the invention. In addition, in the embodiments depicted herein, like reference numerals in the various drawings refer to identical or near identical structural elements.

Moreover, the terms "substantially" or "approximately" as used herein may be applied to modify any quantitative representation that could permissibly vary without resulting in a change in the basic function to which it is related.

FIG. 1 illustrates an exemplary embodiment of boresight verification device (BVD) 100. Housing 10 is cylindrical with back section 14 having a smaller diameter and front section 16 having a larger diameter. Level 30 is shown contained in front section 16 and secured by screws 40*a*, 40*b*. Spring plungers 50*a*, 50*b*, 50*c* are equally spaced on back section 14, with indicator 55 attached to front section 16. Indicator 55 acts as an aiming point for the crosshair of a sight unit, and therefore projects outward from BVD 100.

In the exemplary embodiment shown, level 30 is a more sensitive level than others known in the art. Levels become more sensitive as both length and diameter increase. In the exemplary embodiment shown, level 30 is both longer and larger in diameter than the levels used with current Bore Sight Adapters known in the art. BVD 100 therefore provides a higher degree of accuracy and repeatability than the current Bore Sight Adapters. Level 30 is also positioned for easier viewing and is recessed into the body of BVD 100 to protect it from impact and other adverse conditions.

Figure 2:
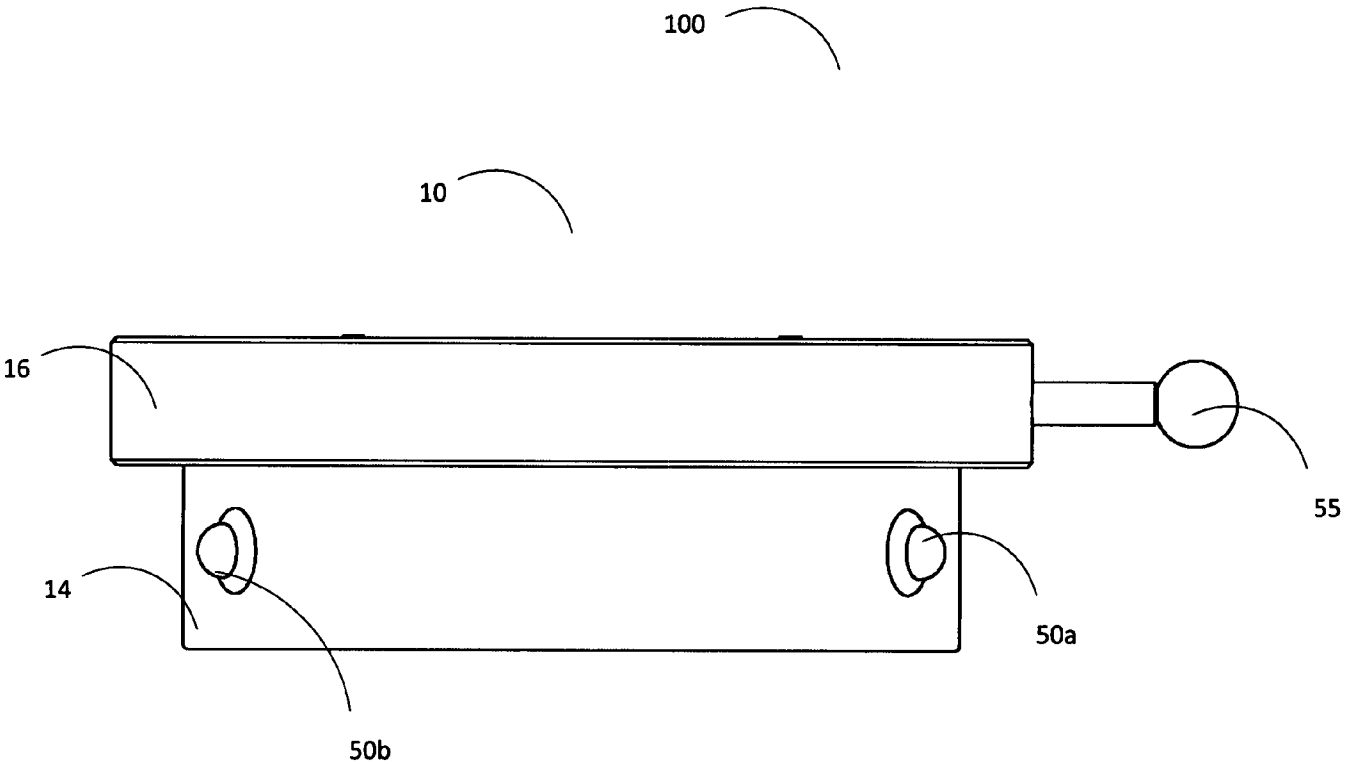
FIG. 2 is a side view of an exemplary BVD.

FIG. 2 is a side view of BVD 100. Two spring plungers 50*a*, 50*c* are shown, with the third spring plunger 50*b* located on the opposite side of BVD 100 and not shown. Indicator 55 is connected to front section 16. In the exemplary embodiment shown, spring plungers 50*a*, 50*b* and 50*c* are symmetrically arranged around BVD 100.

Spring plungers 50*a*, 50*b* and 50*c* grip the inside of a muzzle and center BVD 100 within the muzzle. In further exemplary embodiments, BVD 100 may contain more or fewer spring plungers, and spring plungers may be positioned around BVD 100 in an unsymmetrical arrangement.

Spring plungers 50*a*, 50*b*, 50*c* act as independent yet equal springs, centering BVD 100 in muzzle 92 more accurately and with less physical effort than an o-ring as known in the art. Spring plungers 50*a*, 50*b*, 50*c* also require little to no maintenance, and cannot fall down muzzle 92 of mortar 95 since they are press-fit into place.

In the exemplary embodiment described, spring plungers 50*a*, 50*b*, 50*c* are each made of a plunger, spring and ball nose. In further exemplary embodiments, BVD 100 could use any method to self-center in the bore, including, but not limited to, expanding jaws or collars, spring-loaded feet, tapered shafts and combinations of these and other structures or devices known in the art. An extra set of spring plungers or other centering structure could be added deeper in the bore to provide further stability.

In the exemplary embodiment shown, indicator 55 is a tooling ball comprised of a rod with a rounded knob-like structure at its end. However, in further exemplary embodiments, indicator 55 may be replaced with any other component known in the art to provide a reference point, such as a pointed dowel pin or square edge.

Figure 3:
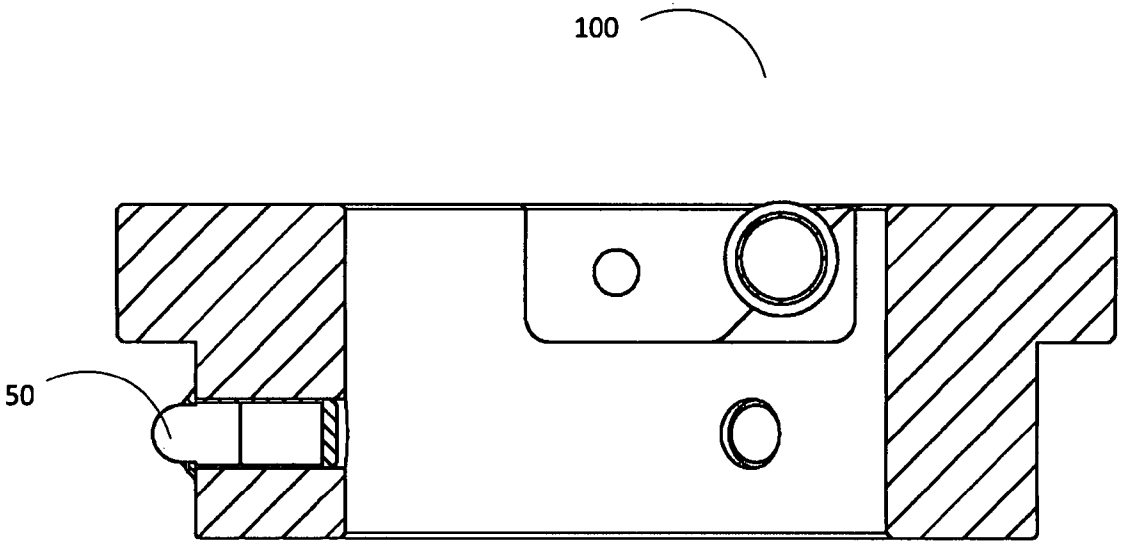
FIG. 3 is a cross-sectional view of an exemplary BVD.

FIG. 3 is a cross-sectional view of BVD 100 taken along the line A-A. Spring plunger 50 is shown seated, and spring plungers 50 remain fully seated during assembly of BVD 100. When inserted into a muzzle, spring plunger 50 exerts an outward force onto the inner surface of the muzzle in order to hold BVD 100 in place.

In the exemplary embodiment shown, spring plunger 50 must exert enough force to keep BVD 100 from falling into a muzzle or slipping out of position. In further exemplary embodiments, spring plungers may include a textured or coated surface to increase the friction between the spring plungers and muzzle's inner surface. For example, spring plungers may contain a rubber, silicone or other coating which increases a spring plunger's gripping ability.

Figure 4:
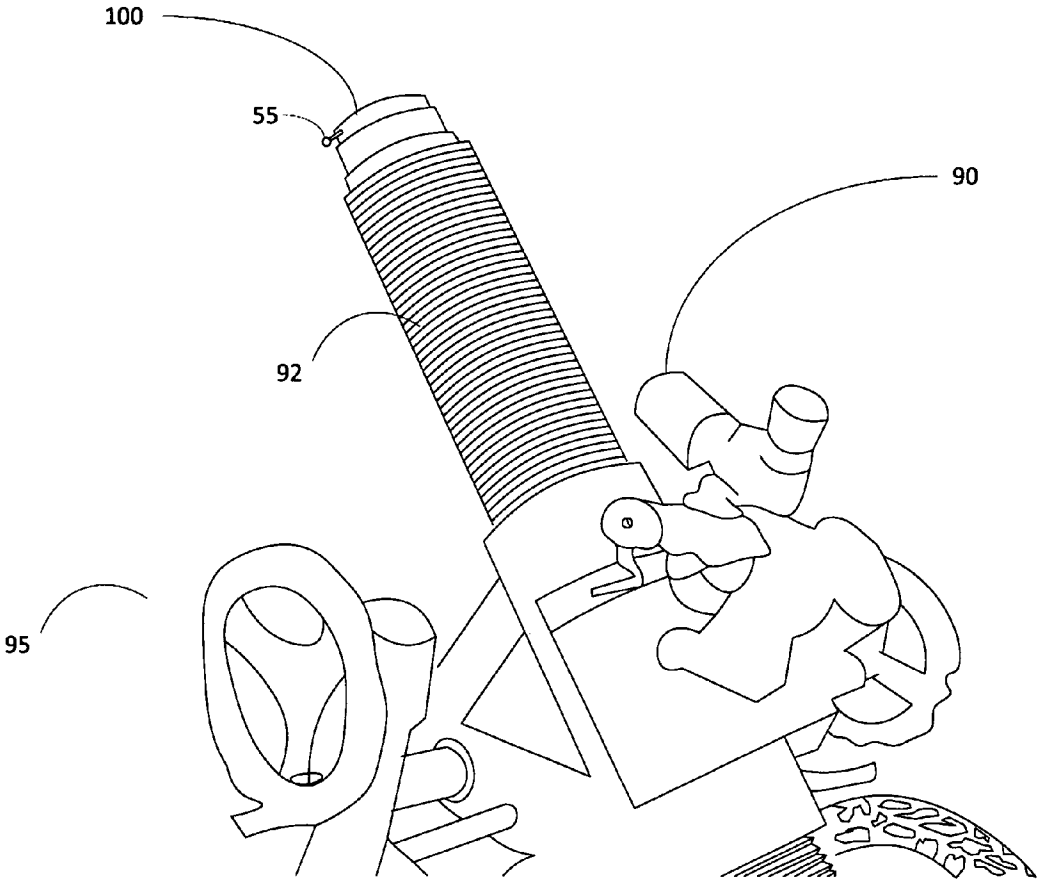
FIG. 4 is an exemplary embodiment of a BVD in use.

FIG. 4 illustrates an exemplary embodiment of BVD 100 in use with boresight verification magnifier 90. As illustrated, BVD 100 is in muzzle 92 of mortar 95. BVD 100 is releasably secured in muzzle 92 through spring plungers 50*a*, 50*b*, 50*c* (not shown), which are manipulated to grip the inside of muzzle 92. Using mortar's 95 sight unit and magnifier 90, the sight unit is adjusted until the crosshairs align with indicator 55. In some exemplary embodiments, BVD 100 may be used with a boresight verification magnifier (BVM) known in the art.

In the exemplary embodiment described, the vertical hairline of the crosshairs is brought tangent to the outer edge of indicator 55. The value for the comparison is then read from the micrometer of the crosshairs and compared to the standard value. pring plungers 50*a*, 50*b* and 50*c*, in combination with the other structures of BVD 100, improves both the repeatability and accuracy of measurement.

In the exemplary embodiments described, BVD 100 is made of aluminum because of aluminum's high strength-weight ratio. However, in further exemplary embodiments, BVD 100 could also be made of any material capable of withstanding the press forces of assembly, including, but not limited to, aluminum, steel, cast iron, and some plastics and polymers.

In the exemplary embodiments shown, indicator 55 is press-fit into a tooled aperture in BVD 100 by a pneumatic or hydraulic press, or any other method which would provide even, mechanical pressure to indicator 55. Indicator 55 has a rod with slightly larger dimensions than its corresponding aperture. When forced into the aperture, indicator 55 is therefore held in place by friction between its rod and its aperture. However, in further exemplary embodiments, indicator 55 may be held in place through any structure or method known in the art, including, but not limited to, corresponding threading, welding, clips, brackets and combinations of these and other joining structures.

Indicator 55 of BVD 100 is press-fit into place with a tightly held tolerance. Indicator 55 facilitates much simpler reference through the sight unit, and its simplicity eliminates much of the tolerance stack-up as seen with the Bore Sight Adapters known in the art, allowing for more repeatable, accurate measurements.

BVD 100 was designed to use a much lower weapon elevation than the Bore Sight Adapters known in the art, which allows for faster emplacement times, and, as a result, less time verification before the mortar is ready to fire rounds on target. The lower elevation also prevents the users from having to move the weapon to verify boresight after firing the mortar, which sinks the mortar baseplate into the ground, as the elevation required to use BVD 100 is always attainable.

Because BVD 100 does not rely on the alignment of optical planes, there is no longer a possibility of being forced to move mortar 95 to verify boresight. BVD 100 and its associated gear are smaller and lighter than the current equipment, allowing for a case almost half the size of the case currently issued.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A boresight verification device for aligning an internal bore of a barrel muzzle for a mortar to an external aim sight, said device comprising:

a cylindrical housing including a front portion to extend beyond the muzzle and a rear portion for insertion into the bore, wherein said portions connect together in tandem along a symmetrical axis of said housing, said rear portion has a smaller diameter than the bore and also said front portion, and said front portion has a recess opposite said rear portion;

at least one level secured transverse to said symmetrical axis within said recess in said front portion of said housing, said level presenting visual verification of orientation perpendicular to vertical direction of acceleration;

a plurality of securing components symmetrically disposed around said rear portion, said securing components engaging the bore; and at least one indicator extending radially beyond the muzzle from said front portion to present a visual reference to the external sight in alignment with said rear portion.

2. The device of claim 1 which includes three securing components.

3. The device of claim 1 wherein said securing components are spring plungers.

4. The device of claim 1 wherein said diameter of said rear portion corresponds to the internal diameter of a mortar muzzle.

5. The device of claim 1 wherein said securing components are selected from the group consisting of spring plungers, expanding jaws or collars, spring-loaded feet, tapered shafts and combinations thereof.

6. The device of claim 1 wherein said securing components are spring plungers.

7. The device of claim 6 wherein said spring plungers include a friction-increasing coating.

8. The device of claim 6 wherein said device includes three spring plungers.

9. The device of claim 1 which further includes an additional securing component adapted to project into a mortar muzzle farther than said rear portion.

10. The device of claim 1 wherein said securing components are further configured to center said rear portion within the mortar muzzle.

11. The device of claim 1 in which said housing comprises a material selected from the group consisting of aluminum, steel, cast iron, plastic, polymers and combinations thereof.

12. The device of claim 1 wherein said indicator is a tooling ball.

13. The device of claim 1 wherein said indicator is selected from the group consisting of a tooling ball, a pointed dowel pin and a square edge.

14. A boresight verification system for aligning a mortar to an external aim sight, said system comprising:

a barrel muzzle for the mortar, said muzzle having an internal bore;

a cylindrical housing including a front portion to extend beyond the muzzle and a rear portion for insertion into the bore, wherein said portions connect together in tandem along a symmetrical axis of said housing, said rear portion has a smaller diameter than said bore and also said front portion, and said front portion has a recess opposite said rear portion;

at least one level secured transverse to said symmetrical axis within said recess in said front portion of said housing, said level presenting visual verification of orientation perpendicular to vertical direction of acceleration;

a plurality of securing components symmetrically disposed around said rear portion, said securing components engaging the bore; and at least one indicator extending radially beyond the muzzle from said front portion to present a visual reference to the external sight in alignment with said rear portion.

15. The system of claim 14 wherein said indicator is a tooling ball.

16. The system of claim 14 wherein said indicator is press fit into position.

17. The system of claim 14 wherein said securing components are spring plungers.

18. The system of claim 14 which further includes a boresight verification magnifier.

* * * * *